US005473218A

United States Patent [19]

Moyer

[11] Patent Number: 5,473,218

[45] Date of Patent: Dec. 5, 1995

[54] DIAMOND COLD CATHODE USING PATTERNED METAL FOR ELECTRON EMISSION CONTROL

[75] Inventor: Curtis D. Moyer, Phoenix, Ariz.

[73] Assignee: Motorola, Schaumburg, Ill.

[21] Appl. No.: 251,415

[22] Filed: May 31, 1994

[51] Int. Cl.[6] ..... H01J 19/00

[52] U.S. Cl. ..... 313/309; 313/336; 313/351; 313/495

[58] Field of Search ..... 313/309, 336, 313/351, 495, 496; 445/50, 49

[56] References Cited

U.S. PATENT DOCUMENTS

| | | | |
|---|---|---|---|
| 3,735,186 | 5/1973 | Klopfer et al. | 313/336 |
| 4,940,916 | 7/1990 | Borel et al. | 313/351 |
| 5,382,812 | 1/1995 | Dreifus | 257/94 |

OTHER PUBLICATIONS

M. W. Geis, et al., Capacitance–Voltage Measurements on Metal–$SiO_2$–Diamond Structures Fabricated with (100)– and (111)–Oriented Substrates, IEEE Transactions on Electron Devices, vol. 38, No. 3, Mar. 1991.

*Primary Examiner*—Sandra L. O'Shea
*Assistant Examiner*—Vip Patel
*Attorney, Agent, or Firm*—Eugene A. Parsons

[57] ABSTRACT

A flat, cold-cathode electron emitter including a substrate having a relatively flat surface with a low work function electron emission material layer for emitting electrons supported on the surface of the substrate. A contact conductive layer is disposed on the electron emission material layer and defines an aperture therethrough. An insulating layer is disposed on the contact conductive layer and has an aperture defined therethrough coextensive and in peripheral alignment with the aperture in the contact conductive layer and a conductive gate layer is disposed on the insulating layer. The contact conductive layer forms the field potential so that emission occurs substantially in the center of the aperture.

22 Claims, 5 Drawing Sheets

-PRIOR ART-

-PRIOR ART-

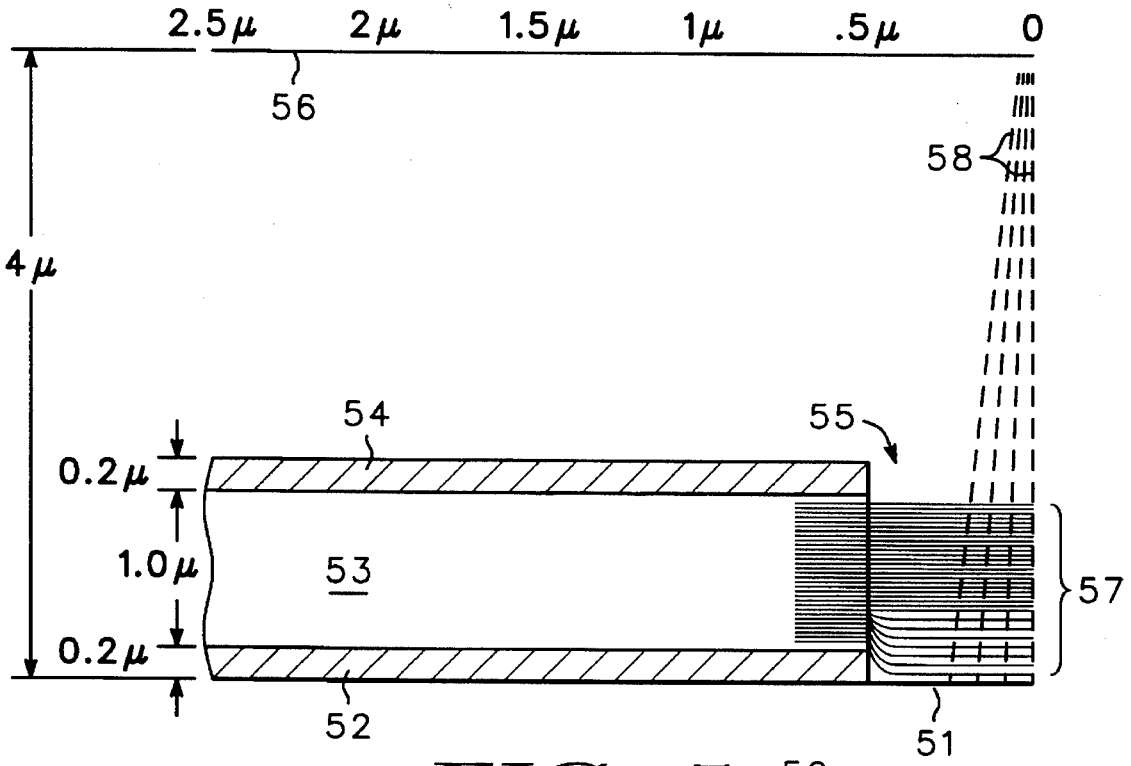
FIG. 5 50
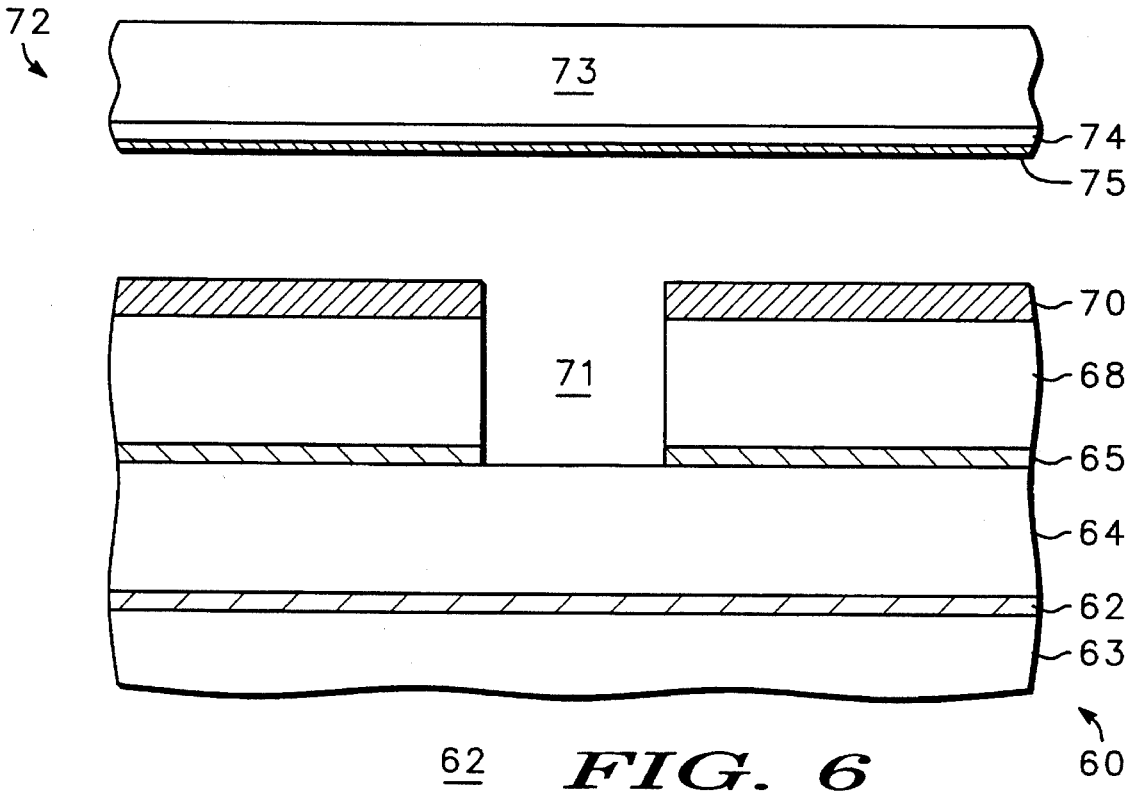
62 FIG. 6

DIAMOND COLD CATHODE USING PATTERNED METAL FOR ELECTRON EMISSION CONTROL

FIELD OF THE INVENTION

This invention relates generally to cold cathode emission devices and more particularly to diamond material electron emitters and similar emitters using low work function material.

BACKGROUND OF THE INVENTION

Cold cathode electron emitters include primarily field emission devices which originally required a very sharp tip to raise the field at the surface of the tip sufficiently to cause electrons to be drawn off, or emitted. Generally, an extraction electrode is formed in the plane of the tip and positioned to completely surround the tip to provide the extraction potential between the tip and the extraction electrode. The major problem with these devices is the difficulty in fabricating the very sharp tip. Further, once the tip is fabricated there is a tendency for the tip to degenerate, or lose particles, as the field emission device is operated.

To solve these problems, there has been a movement toward utilizing low work function material in the emitter. In some instances, such as utilizing a diamond emitter, the emitter can actually be constructed in a flat configuration while still providing a required amount of electron emission with the application of a reasonable potential. Examples of such structures are disclosed in U.S. Pat. No. 5,283,501, entitled "Electron Device Employing a Low/Negative Electron Affinity Electron Source", and assigned to the same assignee.

A problem also exists in these low work function devices in that there is too much extraction grid current. When a sharp tip is utilized, the emission is automatically at the center of the emitter and it is only necessary to focus the electron stream before it strikes an anode/screen. When a flat emitter is utilized, the electrons can be emitted from the surface anywhere in the field and, consequently, a large portion of the emitted electrons flow directly to the extraction electrode. The extraction electrode current greatly reduces the efficiency and operating characteristics of the device.

Accordingly, there exists a need for a flat cold cathode device which overcomes at least some of these shortcomings of the prior art.

It is one purpose of the present invention to provide a new and improved cold cathode electron emitter using patterned metal for electron emission control.

It is another purpose of the present invention to provide a new and improved cold cathode electron emitter in which extraction electrode current is substantially reduced.

It is still another purpose of the present invention to provide a new and improved cold cathode electron emitter in which dielectric and, hence, device breakdown is reduced.

It is yet another purpose of the present invention to provide a new and improved cold cathode electron emitter in which electron injection into surrounding dielectrics is reduced or eliminated.

It is a further purpose of the present invention to provide a new and improved cold cathode electron emitter with improved operating characteristics and efficiency.

SUMMARY OF THE INVENTION

The above problems and others are substantially solved and the above purposes and others are met through provision of a flat, cold-cathode electron emitter including a substrate having a relatively flat surface with a low work function electron emission material layer for emitting electrons supported on the surface of the substrate. A contact conductive layer is disposed on the electron emission material layer and defines an aperture therethrough. An insulating layer is disposed on the contact conductive layer and has an aperture defined therethrough approximately coextensive and in peripheral alignment with the aperture in the contact conductive layer and a conductive gate layer is disposed on the insulating layer. The contact conductive layer forms the field potential so that emission occurs substantially in the center of the aperture.

BRIEF DESCRIPTION OF THE DRAWINGS

FIG. 5 is a simplified schematic computer simulation of one half of a cross-section of the structure of FIG. 3;

FIG. 6 is a partial side elevational schematic representation of another embodiment of a flat field emission display in accordance with the present invention;

DETAILED DESCRIPTION OF THE DRAWINGS

Figure 1:
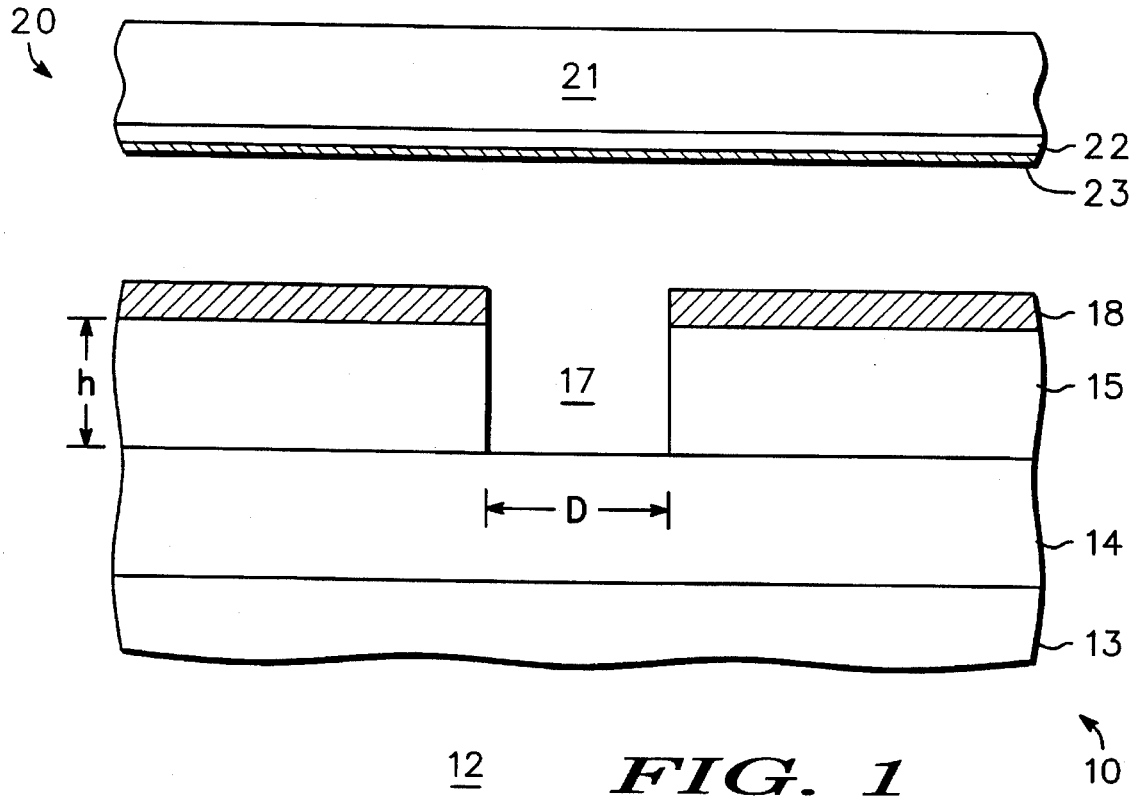
FIG. 1 is a partial side elevational schematic representation of an embodiment of a flat field emission display.

Referring now to FIG. 1 there is depicted a partial side elevational schematic representation of an embodiment of a flat cold cathode electron emitter 10 incorporated into a field emission device 12. Emitter 10 includes a substrate 13 having a layer 14 of low work function material, such as diamond or the like. An insulating layer 15 is deposited on layer 14 so as to define an aperture 17 therethrough. Generally, insulating layer 15 is formed of an oxide, such as silicon dioxide. A conductive layer 18 is deposited on insulating layer 15 and forms an extraction gate for field emission device 12. An optically transparent viewing screen assembly 20 includes a transparent screen 21 having deposited thereon a layer 22 of material such as a cathodoluminescent material layer and a conductive anode layer 23.

Applying a sufficiently positive voltage on anode 23 relative to layer 14 (the cathode) causes layer 14 to emit electrons that are accelerated by the electric field between anode 23 and layer 14. The accelerated electrons pass through anode 23 and impact the cathodoluminescent material of layer 22 resulting in photons (light) being emitted from layer 22. Placing a dielectric or insulating layer 15 and conductive gate layer 18 on layer 14 allows control of the electric field at the surface of layer 14 by modulation of gate layer 18 voltage. Thus, gate layer 18 controls the emission of electrons and a triode type device is formed. Typically, the field due to the anode/cathode bias is less than that required for electron emission to occur from layer 14.

Computer modeling of the triode device indicates that the emission process is at least exponentially thermionic and bordering on Fowler-Nordheim, which is even steeper than a single exponential in its dependence on the surface electric field. Thus, small variations in the spatial field strength profile along the surface of layer 14 lead to large variations in spatial electron emission rates.

Figure 2:
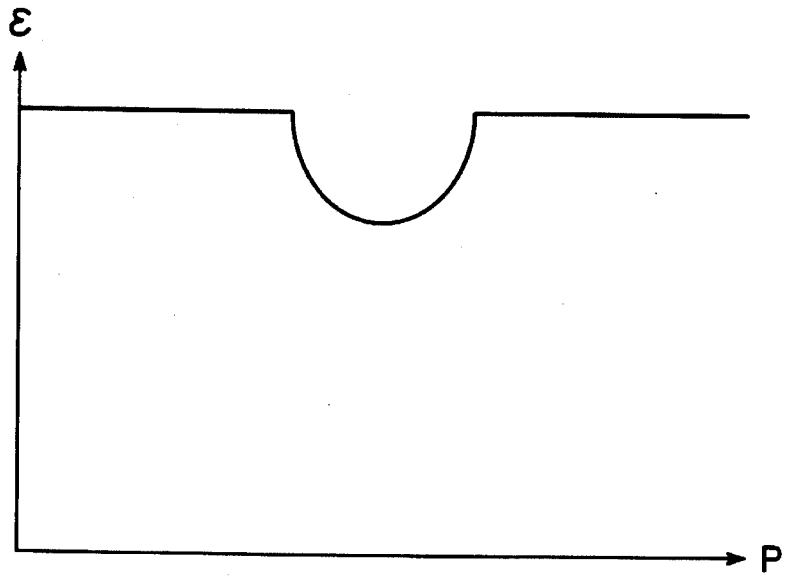
FIG. 2 is a graphical representation of the spatial field strength versus position in the structure of FIG. 1.

For the structure of FIG. 1, with a diameter of D for aperture 17 and a thickness of h=D for insulating layer 15, the surface field at layer 14 peaks at the edge of the gate (layer 18) and slumps in the center of aperture 17 as illustrated in FIG. 2. Referring to FIG. 2, a graphical representation of the spatial field strength, $\epsilon$, versus position, P, in the structure of FIG. 1 is illustrated with the breaks in the field strength occurring at the edge of aperture 17. In the specific embodiment illustrated, the amount that the electric field slumps in the center of aperture 17 is approximately 3%. The electric field peaks at the edge of layer 18, causing emission current to be concentrated at layer 18 and most of the emitted electrons to be collected by layer 18, resulting in high gate current and inefficient operation of field emission device 12.

A further problem in the structure of FIG. 1 is that if layer 18 is formed of diamond it is in direct contact with insulating layer 15, which is generally silicon dioxide ($SiO_2$). As has been noted by Gels et al. in an article entitled "Capacitance-Voltage Measurements on Metal-$SiO_2$-Diamond Structures Fabricated with (100)—and (111)—Oriented Substrates" *IEEE Transactions on Electron Devices*, Vol. 38, No, 3, March 1991, diamond is capable of injecting electrons efficiently into $SiO_2$. As has been demonstrated by hot electron reliability problems in MOSFETs and EPROMs, charge injection over time causes the dielectric to eventually fail (conduct). Thus, field emission device 12 of FIG. 1 has an inherent reliability problem.

Figure 3:
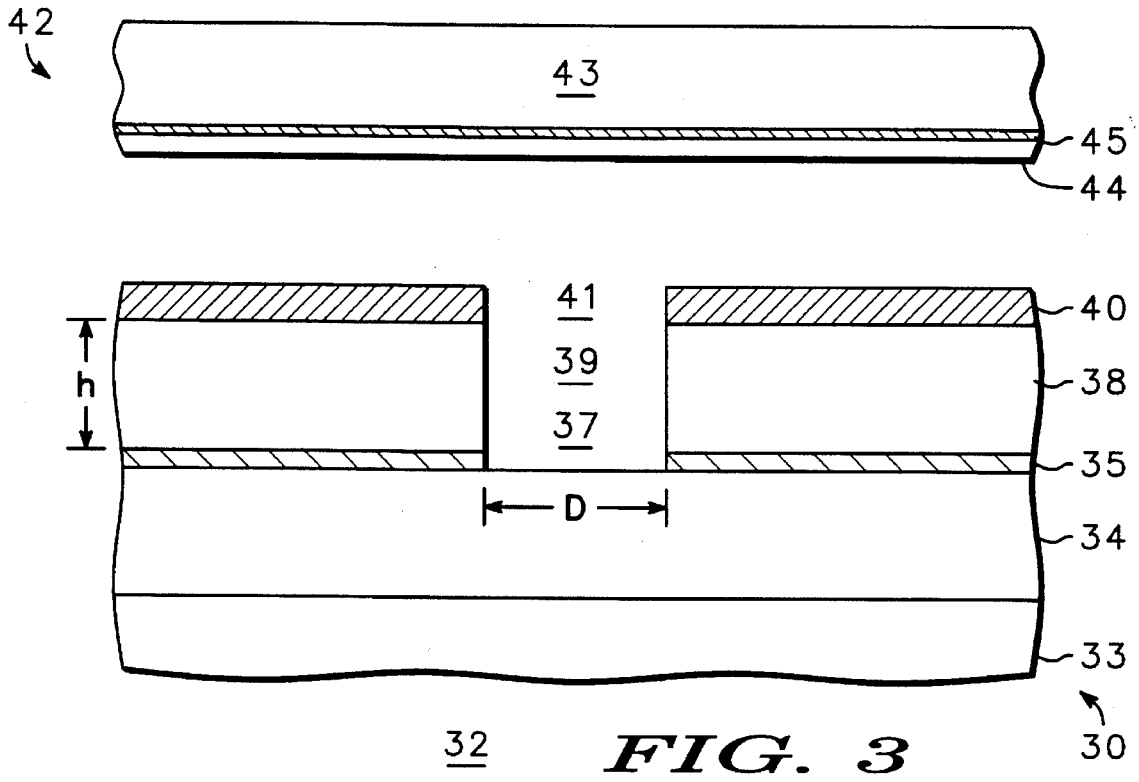
FIG. 3 is a partial side elevational schematic representation of an embodiment of a flat field emission display in accordance with the present invention.

Referring now to FIG. 3, there is depicted a partial side elevational schematic representation of an embodiment of a flat cold cathode electron emitter 30 incorporated into a field emission device 32 in accordance with the present invention. Emitter 30 includes a substrate 33 including a layer 34 of low work function material, such as an electron emissive material exhibiting a surface work function of less than approximately 1.0 electron volts, e.g. diamond, diamond-like carbon material, non-crystalline diamond-like carbon material, aluminum nitride material or the like, disposed on a surface thereof (in this disclosure the term "disposed" refers to the formation of the layer by vapor deposition, epitaxial or other growth, or otherwise formed). It should also be understood that layer 34 can be formed of a plurality of layers, such as, for example, a bilayer of metal or ballast material and diamond or the like deposited thereover or a trilayer of metal, ballast material and diamond or the like.

A conductive contact layer 35, such as metal, heavily doped semiconductor material, etc. is disposed on the surface of layer 34. Contact layer 35 is patterned so as to define an aperture 37 therethrough. An insulating layer 38 is disposed on layer 35 so as to define an aperture 39 therethrough. Generally, insulating layer 38 is formed of an oxide, such as silicon dioxide ($SiO_2$). A conductive layer 40 is disposed on insulating layer 38 and forms an extraction gate for field emission device 32. Conductive layer 40 is patterned so as to define an aperture 41 therethrough. Aperture 37 through layer 35, aperture 39 through layer 38 and aperture 41 through layer 40 are substantially coextensive and peripherally aligned so as to form one continuous aperture through layers 35, 38 and 40. In some instances the edges of apertures 37, 39 and 41 may be slightly peripherally misaligned because of differences in patterning, etching, etc., but such differences are intended to come within the definition of "substantially". In the present embodiment, apertures 37, 39 and 41 also have a circular cross-section and are coaxially aligned but it will be understood that other configurations can be used in specific applications.

An optically transparent viewing screen assembly 42 includes a transparent screen 43 carrying thereon a layer 44 of material such as a cathodoluminescent material layer and a conductive anode layer 45. In some instances, layer 44 is formed of or includes conductive material and acts as the anode to conduct electrical charges away from the surface. In some instances the cathodoluminescent material layer does not conduct well and an additional layer 45 of conductive material may be added. In this embodiment, layer 45 must be transparent (e.g.,ITO or the like) and is deposited on the surface of transparent screen 43 and cathodoluminescent material layer 44 is deposited on the surface of layer 45. This configuration allows for lower screen biases (approximately<3 kv) because the lower velocity electrons do not have to pass through layer 45 to reach layer 44.

Figure 4:
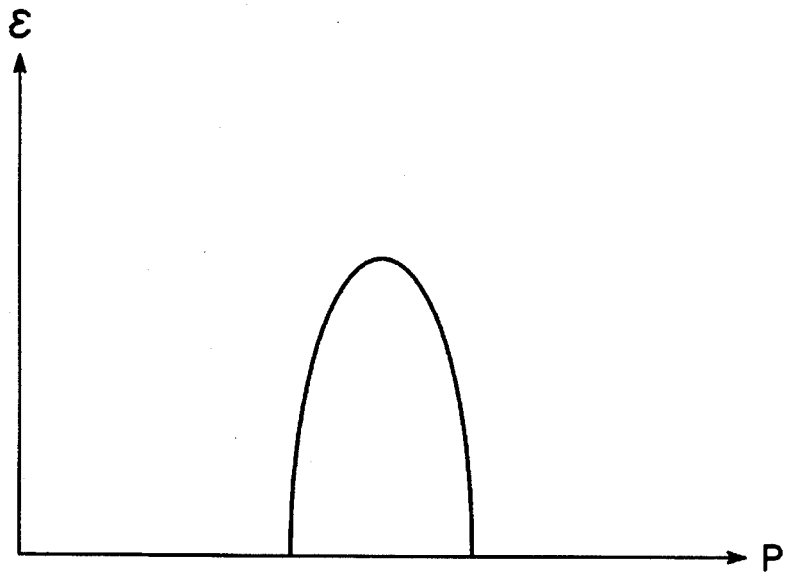
FIG. 4 is a graphical representation of the spatial field strength versus position in the structure of FIG. 3.

In the specific structure of FIG. 3, with a diameter of D for apertures 37, 39 and 41 and a thickness of h for insulating layer 38, the surface field at layer 34 peaks at the center of the gate (layer 40) and drops to zero at the edges of aperture 37 generally as illustrated in FIG. 4. FIG. 4, is a graphical representation of the normal spatial field strength, $\epsilon$, versus position, P, in the structure of FIG. 3.

In a specific embodiment of the present invention, layer 34 is formed of diamond-like carbon, contact layer 35 is formed of metal and insulating layer 38 is formed of silicon dioxide ($SiO_2$). With a thickness h=D for insulating layer 38 and contact layer 35 having a thickness equal to 20% of h, a centered parabolic field distribution results at the surface of layer 34 as illustrated in FIG. 4. Thus, the emission current of flat cold cathode electron emitter 30 is concentrated in the center of the aperture formed by apertures 37, 39 and 41. The reason for the new field profile is most easily understood by realizing that contact layer 35 forces a zero in the normal field distribution on the surface of layer 34 at the edge of aperture 37.

Varying the thickness of contact layer 35 varies the shape of the field profile. That is, a thicker contact layer 35 causes a sharper field profile peak and a thinner contact layer 35 leads to a flattened, but still centered, field profile. Thickening contact layer 35 also decreases the field peak value by shielding the surface of layer 34. Typical reasonable values for thickness h of insulating layer 38, thickness of contact layer 35 and diameter D for aperture 37 are: D=h=1 micron; the thickness of contact layer 35 equals 0.2 microns; and the thickness of the gate (layer 40) is 0.2 microns.

Referring to FIG. 5, one half cross-section of a simulated triode type field emission device 50 (similar to field emission device 32 of FIG. 3) is illustrated in a computer simulation. In this computer simulation, a surface serves as the emitter with a conductive layer 52, a dielectric layer 53 and a conductive gate layer 54 positioned thereon and defining an aperture 55 therethrough. A simulation boundary 56 (representing optically transparent viewing screen assembly 42) is positioned approximately 4 microns from surface 51. One half of layers 52, 53 and 54 are illustrated including one half of aperture 55 defined therethrough. The legend above simulation boundary 56 indicates distance in microns from the center of aperture 55. A group of lines 57 are equipotential lines and a group of broken lines 58 indicate electron paths, or trajectories to simulation boundary 56.

A further feature of field emission device 32 of FIG. 3 is illustrated in the computer simulation of FIG. 5. The simulation illustrates the electron trajectory modification, or focusing, caused by the presence of contact layer 35 (layer 52). Without contact layer 35 the electron trajectories diverge and spread (not shown) as they exit gate aperture 41. The focusing effect of contact layer 35 is due to warping of the field lines caused by field retardation because the normal field at the edge of contact layer 35 is forced to zero by contact layer 35.

Another feature of field emission device 32 of FIG. 3 is that contact layer 35 is sandwiched between diamond layer 34 and insulating layer 38 (formed of silicon dioxide $SiO_2$) and prevents electron injection from the diamond into the silicon dioxide. By preventing direct injection of electrons into the dielectric, injection induced reliability problems are eliminated.

Referring now to FIG. 6, there is depicted a partial side elevational schematic representation of another embodiment of a flat cold cathode electron emitter 60 incorporated into a field emission device 62 in accordance with the present invention. Emitter 60 includes a substrate 63 having a layer 62 of conductive material, such as metal, heavily doped semiconductor material, etc. disposed on the surface of substrate 63. A layer 64 of low work function material, similar to that described above for layer 34, is disposed on a surface of layer 62. A conductive contact layer 65 is disposed on the surface of layer 64 so as to define an aperture therethrough. An insulating layer 68 is disposed on layer 65 so as to define an aperture therethrough. A conductive layer 70 is disposed on insulating layer 68, forming an extraction gate for field emission device 62, and is patterned so as to define an aperture therethrough. The apertures through layer 65, layer 68 and layer 70 are substantially coextensive and coaxially and peripherally aligned so as to form one continuous aperture 71 completely encircled by layers 65, 68 and 70. An optically transparent viewing screen assembly 72 includes a transparent screen 73 carrying thereon a layer 74 of material such as a cathodoluminescent material layer and a conductive layer 75. In this embodiment layer 75 covers layer 74 (forming an anode contact).

Contact layer 65 of electron emitter 60 operates substantially as layer 35 in electron emitter 30 of FIG. 3, described above. Additional conductive layer 62 provides a better contact to layer 64 of low work function material to improve the conductivity and, hence, the emission of electrons.

Figure 7:
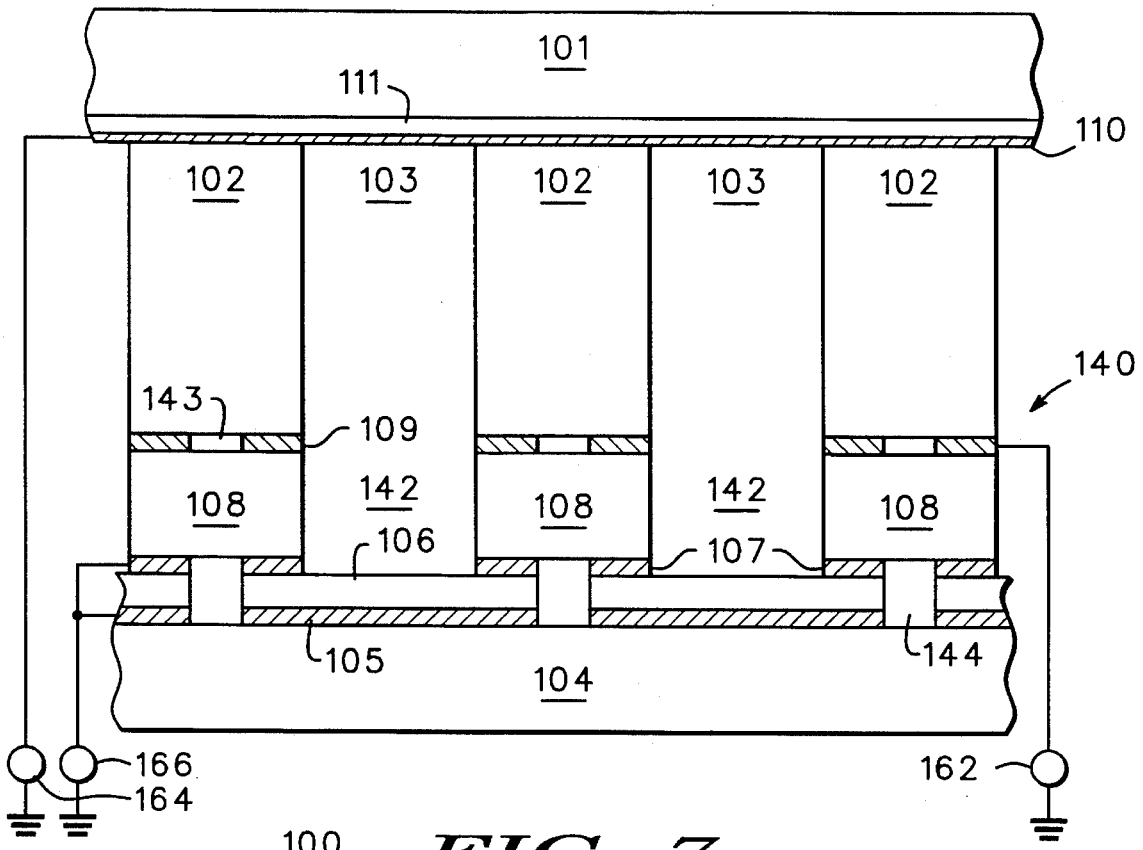
FIG. 7 is side elevational schematic representation of a flat field emission display, reduced in size and greatly simplified, in accordance with the present invention.

Referring now to FIG. 7, there is depicted a partial side elevational schematic representation of an embodiment of a flat image display 100 in accordance with the present invention. A substantially optically transparent viewing screen assembly includes a transparent screen 101 having deposited thereon an energy conversion layer 111 of material such as a cathodoluminescent material layer and a conductive anode layer 110. An interspace insulating layer 102, having interspace apertures 103 defined therethrough and which apertures define an interspace region, is disposed in this specific embodiment on conductive anode layer 110. Interspace apertures 103 are formed with a generally circular cross-section and are surrounded by interspace insulating layer 102.

A plurality of electron emitters are defined by an electron emitter substrate 104 having disposed thereon a conductive layer 105 and an electron emission material layer 106 for emitting electrons. A conductive contact layer 107 is disposed onto the surface of electron emission material layer 106 so as to define apertures therethrough. A substrate insulating layer 108 is disposed on contact layer 107 so as to define apertures therethrough coextensive and axially aligned with the apertures through contact layer 107. A conductive gate layer 109 is disposed on substrate insulating layer 108, having apertures defined therethrough coextensive and axially aligned with the apertures through contact layer 107. The individual apertures through layers 107, 108 and 109 cooperate to form continuous emitter apertures 142. For the embodiment depicted in FIG. 7 conductive gate layer 109 of electron emitter 140 is disposed on interspace insulating layer 102 such that emitter apertures 142 are coextensive and in substantial registration with interspace apertures 103. It should also be noted that insulating spaces 143 separate portions of conductive gate layer 109, so that conductive gate layer 109 is divided into generally ring shaped portions, each of which substantially circumscribes a substrate aperture 142. Similarly, layers 105, 106 and 107 are separated into individual rings by insulating spaces 144. Rows or columns of the various ring shaped portions can be electrically connected for control of individual electron emitters.

Referring once again to FIG. 7 there are further depicted a number of electrical potential sources 162, 164, and 166 each operably connected to one or more elements of the image display. For the purposes of the present discussion, and by no means as a limitation of operation, each of sources 162, 164, and 166 may be operably connected to a reference potential such as, for example only, ground potential. A first source 162 is operably connected between conductive gate layer 109 and the reference potential. A second source 164 is operably connected between conductive anode 110 and the reference potential. A third source 166 is operably connected between conductive layers 105/107, sandwiching electron emissive material layer 106, and the reference potential.

During operation of the image display apparatus, electrons emitted from electron emissive material layer 106 traverse the extent of substrate apertures 142 and interspace apertures 103 to impinge on cathodoluminescent layer 111 wherein the electrons excite photon emission. Source 162 in concert with source 166 functions to control emission of electrons. Source 164 provides an attractive potential which establishes a requisite electric field within interspace apertures 103 and provides for collection of the emitted electrons. Sources 162 and 166 are selectively applied to desired portions of an array of picture elements in a manner which provides for controlled electron emission from associated parts of electron emissive material layer 106. Such controlled electron emission provides for a desired image or plurality of images observable through faceplate 101.

Figure 8:
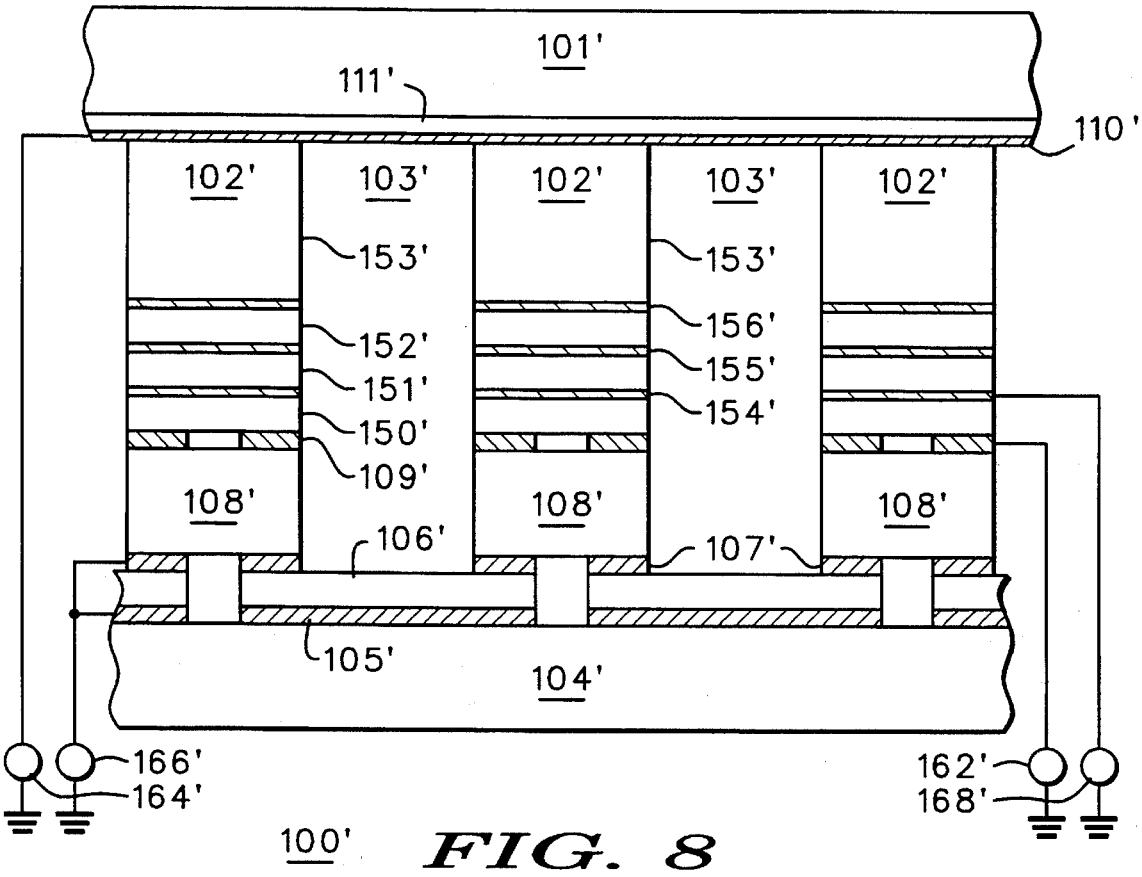
FIG. 8 is side elevational schematic representation of another flat field emission display, reduced in size and greatly simplified, in accordance with the present invention.

A partial side elevational schematic representation of another embodiment of a flat image display 100' in accordance with the present invention, is illustrated in FIG. 8, wherein features previously described in FIG. 7 are similarly referenced and a prime is added to all numbers to indicate a different embodiment. As further depicted in FIG. 8, interspace insulating layer 102' is comprised of a stacked plurality of insulating layers 150'–153' several of which layers has associated therewith a surface on which is deposited a conductive layer 154'–156' such as, for example only, molybdenum, aluminum, titanium, nickel, or tungsten . Thus, individual conductive layers 154'–156' are sandwiched between adjacent insulating layers 150'–153'. Although the depiction of FIG. 8 includes four insulating layers with three conducting layers sandwiched therebetween, it is anticipated that fewer or more such conducting and/or insulating layers may be employed to realize interspace insulating layer 102. It is further anticipated that some or all of insulating layers 150'–153' may be provided without a conductive layer disposed thereon.

Also depicted in FIG. 8 is an electrical potential source 168', such as a voltage source, operably connected between a conductive layer, in this representative example conductive layer 154', and the reference potential. Source 168' is selected to provide a desired modification to the electric field within interspace apertures 103' to affect emitted electron trajectories in transit to energy conversion layer 111'. Other electrical potential sources, not depicted, may be similarly employed at other of conductive layers 155' and 156' if desired.

Figure 9:
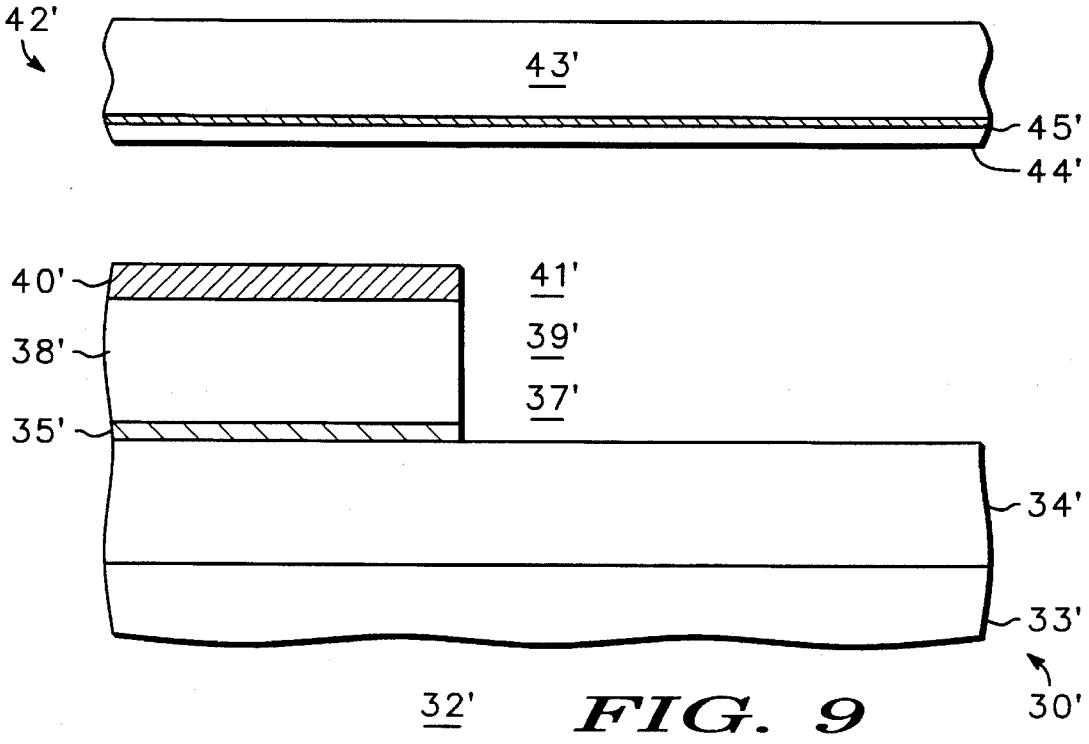
FIG. 9 is a partial side elevational schematic representation of still another embodiment of a flat field emission display in accordance with the present invention.

Referring now to FIG. 9, there is depicted a partial side elevational schematic representation of still another embodiment of a flat cold cathode electron emitter 30' incorporated into a field emission device 32' in accordance with the present invention. The structure of FIG. 9 is similar to that of FIG. 3 and similar components are designated with similar numbers, all of the numbers having a prime added to indicate the different embodiment. Emitter 30' includes a substrate 33' including a layer 34' of low work function material disposed on a surface thereof. As previously explained, layer 34' can be formed of a plurality of layers of metal and/or ballast material and diamond or the like deposited thereover.

A conductive contact layer 35' is disposed on the surface of layer 34'. Contact layer 35' is patterned so as to define an aperture 37' therethrough. An insulating layer 38' is disposed on layer 35' so as to define an aperture 39' therethrough. A conductive layer 40' is disposed on insulating layer 38' and forms an extraction gate for field emission device 32'. Conductive layer 40' is patterned so as to define an aperture 41' therethrough. Aperture 37' through layer 35', aperture 39' through layer 38' and aperture 41' through layer 40' are substantially coextensive and peripherally aligned so as to form one continuous aperture.

Only single edges of apertures 37', 39' and 41' are illustrated in FIG. 9 but it should be understood that other edges may be present "far away" so they do not modify the field distribution of each other. Apertures 37', 39' and 41' may have a large circular cross-section, they may be elongated channels, etc. The virtually separate edges of apertures 37', 39' and 41' allows the formation (e.g. by lithography/patterning) to be relatively gross and makes the structure relatively easy to fabricate.

An optically transparent viewing screen assembly 42' includes a transparent screen 43' carrying thereon a layer 44' of material such as a cathodoluminescent material layer and a transparent conductive anode layer 45'. In this embodiment, layer 45' is deposited on the surface of transparent screen 43' and cathodoluminescent material layer 44' is deposited on the surface of layer 45' to allow for lower screen biases.

Figure 10:
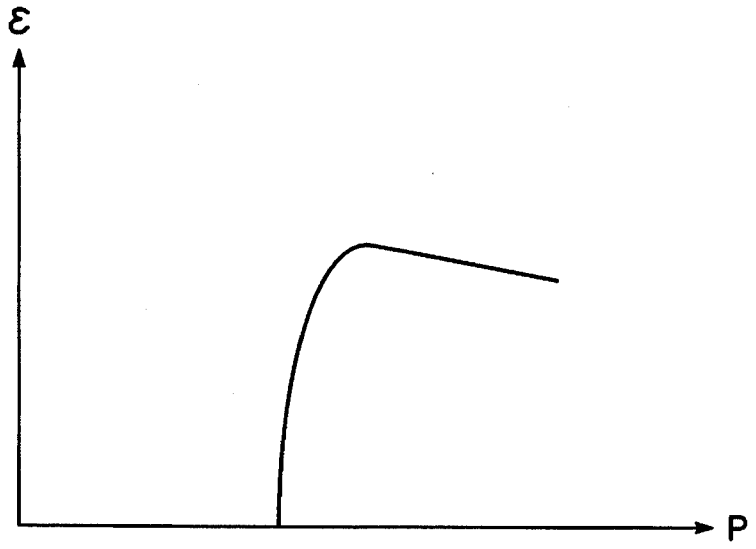
FIG. 10 is a graphical representation of the spatial field strength versus position in the structure of FIG. 9

A simulated field distribution is illustrated graphically in FIG. 10 for the structure of FIG. 9 wherein the normal spatial field strength, $\epsilon$, is plotted versus position, P, in the structure of FIG. 9. The field distribution at the surface of layer 34' causes the electron emission to occur away from the edge of layer 40' (the gate). Trajectory simulation shows that the emitted electrons miss the gate although the trajectories do diverge, i.e., they are not focused. Focusing of emitted electrons in embodiments similar to this can be accomplished, for example, with a structure similar to that illustrated in FIG. 8 by utilizing one or more of the additional conductive layers 154'–156'.

Thus, a new and improved cold cathode electron emitter using patterned metal for electron emission control is disclosed. Because of the novel construction of the new and improved cold cathode electron emitter, electron injection into surrounding dielectrics is reduced or eliminated and extraction electrode current is substantially reduced. Also, this reduction in electron injection into surrounding dielectrics substantially reduces dielectric and, hence, device breakdown and greatly increases device reliability. The novel construction of the new and improved cold cathode electron emitter also improves operating characteristics and efficiency. In addition to the above advantages, the new and improved cold cathode electron emitter incorporates automatic focusing of the electron beam at the distally disposed anode which improves the use of the emitter in displays and the like. Consequently, structurally sound image display apparatus has been disclosed which does not employ discrete supporting spacers between the electron emitting layer and the cathodoluminescent layer.

While I have shown and described specific embodiments of the present invention, further modifications and improvements will occur to those skilled in the art. I desire it to be understood, therefore, that this invention is not limited to the particular forms shown and I intend in the append claims to cover all modifications that do not depart from the spirit and scope of this invention.

What is claimed is:

1. A flat, cold-cathode electron emitter comprising;

a substrate having a relatively flat surface;

a low work function electron emission material layer for emitting electrons supported on the surface of the substrate;

a contact conductive layer disposed on the low work function electron emission material layer and having an aperture defined therethrough;

an insulating layer disposed on the contact conductive layer and having an aperture defined therethrough substantially in peripheral alignment with the aperture in the contact conductive layer; and a conductive gate layer disposed on the insulating layer.

2. A flat, cold-cathode electron emitter as claimed in claim 1 wherein the low work function electron emission material layer includes diamond material.

3. A flat, cold-cathode electron emitter as claimed in claim 1 wherein the low work function electron emission material layer includes diamond-like carbon material.

4. A flat, cold-cathode electron emitter as claimed in claim 1 wherein the low work function electron emission material layer includes non-crystalline diamond-like carbon material.

5. A flat, cold-cathode electron emitter as claimed in claim 1 wherein the low work function electron emission material layer includes aluminum nitride material.

6. A flat, cold-cathode electron emitter as claimed in claim 1 wherein the low work function electron emission material layer includes an electron emissive material exhibiting a surface work function of less than approximately 1.0 electron volts.

7. A flat, cold-cathode electron emitter as claimed in claim 2 wherein the contact conductive layer includes metal.

8. A flat, cold-cathode electron emitter as claimed in claim 7 wherein the insulating layer disposed on the contact conductive layer includes silicon dioxide.

9. A flat, cold-cathode electron emitter as claimed in claim 1 including in addition a conductive layer sandwiched between the substrate and the low work function electron emission material layer.

10. A field emission device with a flat electron emitter comprising;

an electron emitter positioned in spaced relation to an optically transparent faceplate assembly and including an electron emission material layer for emitting electrons, a conductive contact layer disposed on the electron emission material layer and defining an aperture therethrough, an insulating layer disposed in overlying relationship to the conductive contact layer and having an aperture defined therethrough substantially coextensive and in peripheral alignment with the aperture in the contact conductive layer, and a conductive gate layer disposed on the insulating layer and having an aperture defined therethrough substantially coextensive and in peripheral alignment with the aperture in the conductive contact layer and the insulating layer; and an optically transparent faceplate assembly having a major surface and including a transparent faceplate and cathodoluminescent material carried thereby, the major surface of the optically transparent faceplate overlying the aperture defined through the conductive contact layer, the insulating layer and the conductive gate layer opposite the electron emission material layer.

11. A laminated field emission device with flat electron emitter as claimed in claim 10 wherein the optically transparent faceplate assembly includes a transparent faceplate with a major surface, a transparent conductive anode disposed on the major surface and cathodoluminescent material disposed on the conductive anode.

12. A laminated field emission device with flat electron emitter as claimed in claim 1 including in addition an interspace layer disposed on the major surface of the faceplate assembly and having an aperture defined therethrough which aperture is substantially coextensive and peripherally aligned with the aperture defined through the conductive contact layer, the insulating layer and the conductive gate layer.

13. A laminated field emission device with flat electron emitter as claimed in claim 12 wherein the interspace layer includes a plurality of layers.

14. A laminated field emission device with flat electron emitter as claimed in claim 13 wherein each of the plurality of layers of the interspace layer has a surface and a conductive layer is disposed on the surface of at least some of the plurality of layers of the interspace layer.

15. A field emission device with a flat electron emitter comprising;

an optically transparent faceplate assembly having a major surface and including a transparent faceplate, cathodoluminescent material and a conductive anode;

an interspace insulating layer disposed on the major surface of the faceplate assembly and having an aperture defined therethrough which aperture further defines an interspace region;

an electron emitter including an electron emission material layer for emitting electrons, a conductive contact layer disposed on the electron emission material layer, an insulating layer disposed in generally overlying relationship to the conductive contact layer, a conductive gate layer disposed on the substrate insulating layer, the electron emitter having at least one aperture defined through the conductive contact layer, the insulating layer and the conductive gate layer and the electron emitter being disposed on the interspace insulating layer such that the conductive gate layer is interposed between the conductive anode and the electron emitter layer and further disposed such that the aperture defined through the electron emitter is substantially peripherally aligned with the aperture defined through the interspace insulating layer, such that upon evacuation of the aperture defined through the electron emitter substrate and the aperture defined through the interspace insulating layer, electrons emitted by the electron emission material layer, traverse the extent of the interspace region to excite photon emission from the cathodoluminescent material.

16. A field emission device with a flat electron emitter as claimed in claim 15 wherein the electron emissive material layer is comprised of diamond material.

17. A field emission device with a flat electron emitter as claimed in claim 15 wherein the electron emissive material layer is comprised of diamond-like carbon material.

18. A field emission device with a flat electron emitter as claimed in claim 15 wherein the electron emissive material layer is comprised of non-crystalline diamond-like carbon material.

19. A field emission device with a flat electron emitter as claimed in claim 15 wherein the electron emissive material layer is comprised of aluminum nitride material.

20. A field emission device with a flat electron emitter as claimed in claim 15 wherein the electron emissive material layer is comprised of an electron emissive material exhibiting a surface work function of less than approximately 1.0 electron volts.

21. A field emission device with a flat electron emitter as claimed in claim 15 wherein the interspace insulating layer is comprised of a plurality of layers.

22. A field emission device with a flat electron emitter as claimed in claim 21 wherein each of the plurality of layers of the interspace insulating layer has a surface and a conductive layer is disposed on the surface of at least some of the plurality of layers.

* * * * *